United States Patent [19]

Wittlinger

[11] 4,399,398

[45] Aug. 16, 1983

[54] VOLTAGE REFERENCE CIRCUIT WITH FEEDBACK CIRCUIT

[75] Inventor: Harold A. Wittlinger, Pennington, N.J.

[73] Assignee: RCA Corporation, New York, N.Y.

[21] Appl. No.: 279,194

[22] Filed: Jun. 30, 1981

[51] Int. Cl.[3] ..... G05F 1/613; G05F 3/20

[52] U.S. Cl. ..... 323/226; 323/314

[58] Field of Search ..... 307/296 R, 297; 323/226, 311-316; 330/296, 297

[56] References Cited

U.S. PATENT DOCUMENTS

| | | | |
|---|---|---|---|
| 3,612,984 | 10/1971 | Davis et al. | 323/314 |
| 3,617,859 | 11/1971 | Dobkin et al. | 323/313 |
| 3,942,046 | 3/1976 | Limberg | 307/297 |
| 4,017,788 | 4/1977 | Stepp et al. | 323/226 |
| 4,058,760 | 11/1977 | Ahmed | 323/314 |
| 4,059,793 | 11/1977 | Ahmed | 323/313 |
| 4,063,149 | 12/1977 | Crowle | 323/315 |
| 4,085,359 | 4/1978 | Ahmed | 323/314 |
| 4,189,671 | 2/1980 | Yuen | 323/314 |
| 4,249,122 | 2/1981 | Widlar | 323/313 |
| 4,287,467 | 9/1981 | Gloaguen | 323/314 |
| 4,302,718 | 11/1981 | Schade | 323/313 |
| 4,325,018 | 4/1982 | Schade | 323/313 |

OTHER PUBLICATIONS

*RCA Linear Integrated Circuit Databook*, SSD-240A, 1978: CA 3018 Data Sheet, pp. 87-89; CA 3086 Data Sheet, pp. 162-163.

Theriault, G. et al., "Application of the RCA-CA3018 Integrated Circuit Transistor Array", Application Note ICAN-5296, *RCA Linear Integrated Circuits Application Notes*, Databook SSD-202C, 1975, pp. 193-197.

*Circuit Ideas for RCA Linear Ics*, RCA, 1977, p. 18.

R. J. Widlar, "Low Voltage Techniques", *IEEE Journal of Solid-State Circuits*, vol. SC-13, No. 6, Dec. 1978, pp. 838-846.

R. J. Widlar, "Low Voltage Techniques", *1978 IEEE Int'l. Solid-State Circuits Conference, Digest of Technical Papers*, pp. 238-239.

*Primary Examiner*—A. D. Pellinen

*Attorney, Agent, or Firm*—E. M. Whitacre; P. J. Rasmussen; C. A. Berard, Jr.

[57] ABSTRACT

A bandgap reference voltage generating circuit develops a predetermined reference potential between first and second terminals. A pair of transistors are operated at different emitter current densities to develop a difference between their base-emitter potentials. That difference is applied across a first resistance and is increased and applied across a second resistance. The reference potential comprises the sum of at least the scaled-up potential and the conduction potential of a semiconductor junction. A regulating transistor completes a degenerative feedback connection and controls the current flowing between the first and second terminals responsive to the reference potential departing from the predetermined value. A regenerative feedback connection responds to the current in the regulating transistor to decrease the potential across the second resistance when the controlled current increases.

7 Claims, 2 Drawing Figures

VOLTAGE REFERENCE CIRCUIT WITH FEEDBACK CIRCUIT

Figure 1:
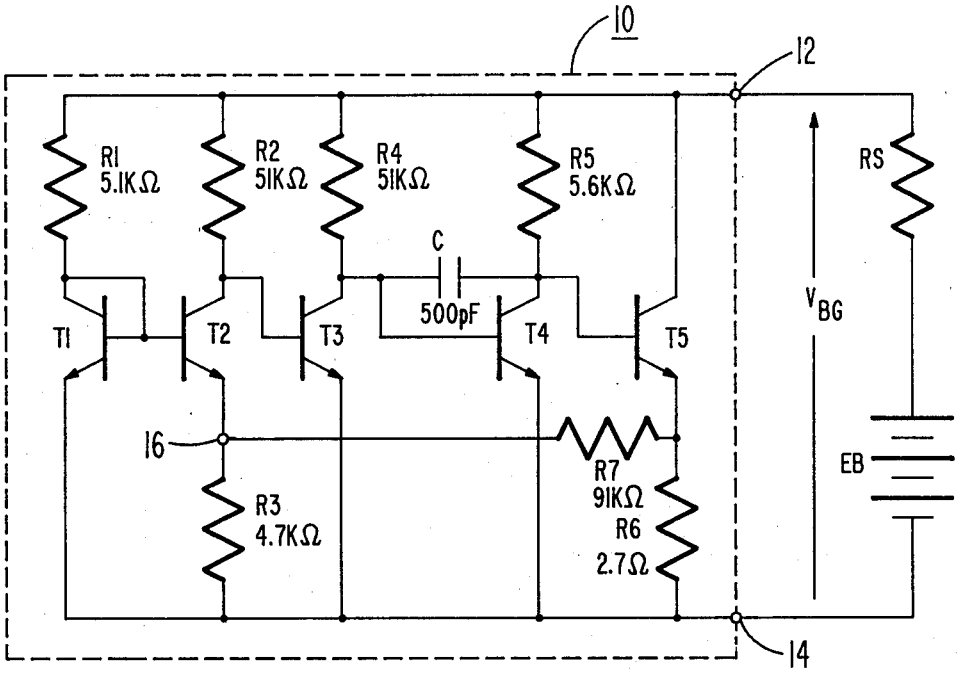

The present invention relates generally to electronic circuits for developing a reference potential, and specifically to those employing a regenerative feedback circuit.

Voltage reference circuits, commonly referred to as "band-gap voltage reference circuits", can be employed as a two-terminal voltage regulator substitutable for an avalanche diode. In that case, it is desired that its potential be substantially unaffected as the current through the reference circuit varies substantially. In other words, a two-terminal voltage reference circuit should exhibit a very low resistance.

To that end, a circuit for developing a predetermined value of reference potential between a pair of terminals according to the present invention includes a pair of transistors conditioned to operate at different emitter current densities to develop a difference between their respective base-emitter potentials. That difference potential is applied to a first resistance and is increased and applied across a second resistance in proportion to the first and second resistances. At least the potential across the second resistance is summed with the conduction potential of a semiconductor junction to develop the reference potential. The portion of the present invention for maintaining the reference potential at the predetermined value comprises a regulating apparatus providing a degenerative feedback configuration for controlling the current flowing between the terminals when the reference potential departs from the predetermined value. A regenerative feedback configuration controls the potential across the second resistance responsive to the controlled current.

Figure 2:
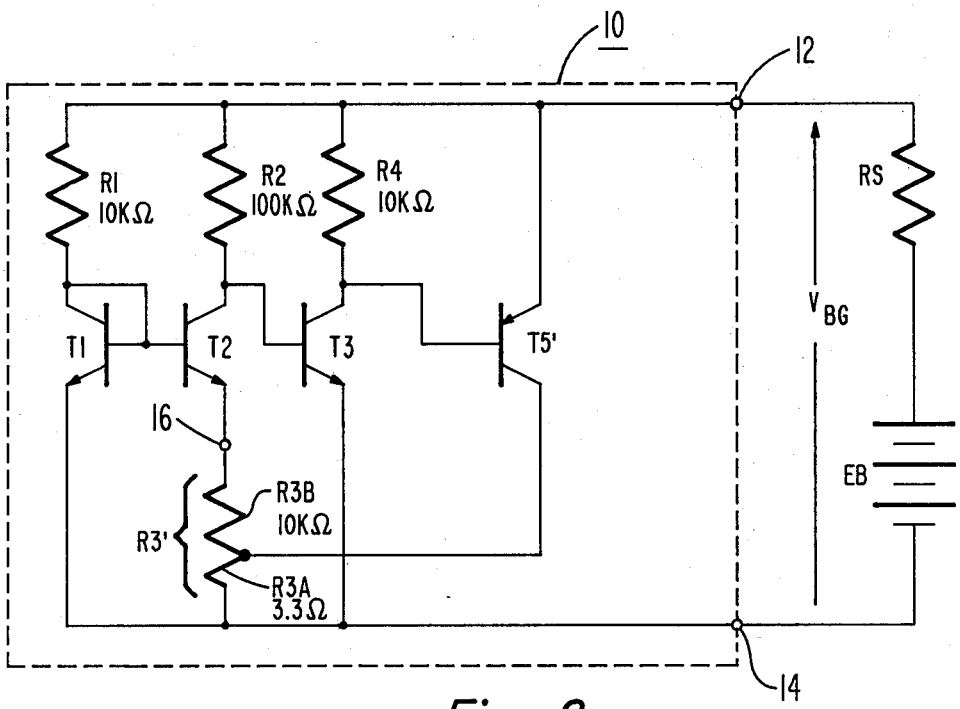

In the drawing:

FIGS. 1 and 2 are schematic diagrams of exemplary embodiments including the present invention.

Voltage reference circuit 10 of FIG. 1 serves as a two-terminal voltage regulator for maintaining the potential between terminals 12 and 14 at a predetermined value $V_{BG}$. That value is maintained substantially constant irrespective of variations in the current conducted by regulator 10 between terminals 12 and 14 owing to variations in voltage source EB, shown by way of example as a battery, and in source resistance RS. Regulator 10 could be substituted for an avalanche diode connected between terminals 12 and 14.

To develop a reference potential, NPN transistors T1 and T2 are conditioned to operate at different emitter current densities. The emitter currents of T1 and T2 are $$I_{E-T1}=(V_{BG}-V_{BE-T1})/R1 \quad (1)$$

and $$I_{E-T2}=(V_{BG}-V_{BE-T3})/R2. \quad (2)$$

In equations (1) and (2), $I_{E-T1}$ and $I_{E-T2}$ are the emitter currents of transistors T1 and T2, respectively, and $V_{BE-T1}$ and $V_{BE-T2}$ are the base-emitter voltages of T1 and T2, respectively.

Since the base-emitter voltages $V_{BE}$ of T1 and T2 are nearly the same, the emitter currents of T1 and T2 are substantially determined by the values of resistors R1 and R2. Thus, the ratio of their emitter currents is $$I_{E1}/I_{E2}\simeq R1/R2. \quad (3)$$

When T1 and T2 are of like emitter junction area, their emitter current densities are also in about R1/R2 ratio. Alternatively, the desired ratio of emitter current densities can be obtained by using transistors of different emitter junction areas and adjusting the current ratio accordingly.

When the emitter current densities of T1 and T2 are selected in about 10:1 ratio, their base-emitter voltages differ by about 60 millivolts. Because the bases of T1 and T2 connect together, that difference potential ΔVBE is developed between terminals 14 and 16 and is applied across resistor R3. R3 thus conducts a current determined by ΔVBE and is of value selected so that its current is substantially the same as the collector-emitter current of T2. Since the resistance of R7 is substantially larger than that of R3, the current in R7 is relatively small. Thus, to simplify the immediately following description, the quiescent current in R7 will be ignored even though it is supplied from the emitter of T2.

Since substantially equal currents flow in R2 and R3, the voltage developed across R2 is ΔVBE increased by the resistance ratio R2/R3. ΔVBE, and thus the voltage across R2, exhibit a positive temperature coefficient (PTC). Since the emitter currents of T1 and T2 are in selected ratio, the potential across R1 is substantially the same as that across R2. The R1 PTC voltage is summed with the $V_{BE}$ of T1 because they are in series connection between terminals 12 and 14. That sum is about 1.25 volts; $V_{BE-T1}$ has a negative temperature coefficient (NTC). The relative values of R2 and R3 are selected so that the PTC of the voltage across R2, and therefore that across R1, is of substantially the same magnitude as the NTC of T1. As a result, the summed voltage can have substantially zero temperature coefficient. It is noted that the PTC voltage across R2 is summed with the NTC $V_{BE}$ of T3 and that sum also equals $V_{BG}$.

A degenerative (negative) feedback connection is employed to maintain the potential between terminals 12 and 14 at $V_{BG}$ by conducting current therebetween, primarily in the collector-emitter path of NPN transistor T5. NPN transistors T3 and T4 are cascade-connected common-emitter amplifiers including collector resistors R4 and R5, respectively. If $V_{BG}$ were assumed to increase, then the voltage at T2 collector increases causing T3 to conduct more heavily. That, in turn, reduces the collector voltage of T3 causing T4 to conduct less heavily, thus increasing its collector voltage and causing T5 to conduct more heavily. That increased current in T5 increases the current flowing in RS to return $V_{BG}$ to its predetermined value. Opposite changes occur to return $V_{BG}$ if it were assumed to have decreased. Capacitor C stabilizes the degenerative feedback loop against undesirable oscillations.

The degree to which the shunt regulation feedback just described corrects changes in $V_{BG}$ depends upon the magnitude of the gain of T3, T4 and T5. Since that gain is finite in practical circuits, a finite change in $V_{BG}$ results from any given change in current flowing in regulator 10. As a result, regulator 10 exhibits an apparent non-zero resistance.

To reduce this resistance, a regenerative (positive) feedback connection responds to the current flow in T5. Resistor R6, of relatively small value compared to R3 or R7, develops a voltage proportional to the emitter current of T5.

Because the voltage across R3 is determined by ΔVBE and thus tends to not change, the voltage across resistor R7 decreases by the amount of the increase in the R6 voltage. That decreases the current flow in R7 which decreases the current supplied from the emitter of T2. That decrease reduces the voltage across R2 which increases the T2 collector voltage. As described above, that increase is coupled by T3 and T4 to cause T5 to conduct slightly more heavily thereby to further reduce $V_{BG}$. The values of R6 and R7 are selected so that the change of $V_{BG}$ is reduced to the desired low value when the current flowing in regulator 10 varies between its minimum and maximum levels.

In a circuit constructed with the values shown in FIG. 1 and with T1–T5 being an RCA CA3086 transistor array, $V_{BG}$ was 1.238 volts when one milliampere was conducted by regulator circuit 10. Over a range of that current from 0.5 to 5.0 milliamperes, the resistance exhibited was less than 0.05 ohms. $V_{BG}$ exhibited a temperature coefficient of about 0.01% per degree Celsius.

Modifications to the embodiment described are contemplated, and the present invention is limited only by the claims following. For example, FIG. 2 is a modification wherein resistor R7 has been deleted and the function of R6 is performed by portion R3A of resistor R3′ which has a very low resistance compared to that of portion R3B. FIG. 2 further differs in that NPN transistors T4 and T5 are replaced by PNP transistor T5′; such replacements and modifications are satisfactory so long as the relationship that increasing voltage at the T2 collector causes increased current flow between terminals 12 and 14. The remainder of the circuit of FIG. 2 operates in like manner to that previously described in relation to FIG. 1.

What is claimed is:

1. A circuit for developing a predetermined value of reference potential between first and second terminals comprising:

a pair of transistors;

first and second resistances;

means connecting said pair of transistors and said first and second resistances in circuit between said first and second terminals for operating said pair of transistors at different emitter current densities to develop a difference between their respective base-emitter potentials, wherein said first resistance is connected for receiving said difference potential and said second resistance is connected for receiving said difference potential increased in proportion to the resistances of said first and second resistances, and wherein at least the potential across said second resistance is summed with the conduction potential of at least one semiconductor junction to develop said reference potential between said first and second terminals;

regulating means, coupled between said first and second terminals to conduct a controlled current therebetween, for maintaining said reference potential at said predetermined value by increasing and decreasing said controlled current flowing between said first and second terminals in response to said reference potential departing from said predetermined value in increasing and decreasing senses, respectively, wherein said regulating means provides a degenerative (negative) feedback connection; and control means for maintaining said reference potential at said predetermined value by controlling the potential across said second resistance in response to said controlled current flowing through said regulating means, wherein said control means provides a regenerative (positive) feedback connection.

2. The circuit as set forth in claim 1 wherein:

said regulating means is connected between said first and second terminals for conducting said controlled current therebetween; and said control means decreases and increases the potential across said second resistance responsive to increase and decrease, respectively, in said controlled current.

3. The circuit as set forth in claim 2 wherein said control means includes means for causing said controlled current to flow in a portion of said first resistance.

4. The circuit as set forth in claim 2 wherein said control means includes a third resistance through which said controlled current flows, means for connecting one end of said third resistance to one end of said first resistance, and a fourth resistance connected between the respective other ends of said first resistance and said third resistance.

5. The circuit as set forth in claim 4 wherein said third resistance exhibits a resistance substantially less than that of said first resistance and said fourth resistance exhibits a resistance substantially greater than that of said first resistance.

6. The circuit as set forth in claim 3 or 4 wherein the one end of said first resistance connects to said first terminal and the other end thereof connects to the emitter electrode of a first one of said pair of transistors, the emitter electrode of the other of said pair of transistors connects to said first terminal, and the respective base electrodes of said pair of transistors connect together.

7. The circuit as set forth in claim 1 or 2 wherein said regulating means includes:

a regulating transistor having a principal conduction path between its output and common electrodes coupled between said first and second terminals, and having an input electrode coupled for receiving an error signal; and means responsive to said reference potential for developing said error signal poled to increase the conduction of said regulating transistor when the potential between said first and second terminals exceeds said predetermined value.

* * * * *